United States Patent [19]

Fales

[11] 4,306,653

[45] Dec. 22, 1981

[54] METHOD AND APPARATUS FOR PACKAGING FRAGILE ARTICLES

[76] Inventor: Gene T. Fales, 5412 Ainsworth Dr., Greensboro, N.C. 27410

[21] Appl. No.: 126,180

[22] Filed: Mar. 3, 1980

[51] Int. Cl.[3] ..... B65D 85/30; B65D 81/02

[52] U.S. Cl. ..... 206/326; 206/497; 206/521

[58] Field of Search ..... 206/521, 588, 591, 593, 206/326, 320, 500, 499, 497, 318, 45.33

[56] References Cited

U.S. PATENT DOCUMENTS

| | | | |
|---|---|---|---|
| 177,588 | 5/1876 | Tarbox | 206/500 |
| 2,936,880 | 5/1960 | Kohlhaas | 206/320 |
| 4,189,051 | 2/1980 | Fales et al. | 206/326 |

FOREIGN PATENT DOCUMENTS

| | | | |
|---|---|---|---|
| 2302069 | 7/1974 | Fed. Rep. of Germany | 206/497 |

*Primary Examiner*—William T. Dixson, Jr.

*Attorney, Agent, or Firm*—Charles R. Rhodes; Judith G. Smith

[57] ABSTRACT

A packaging container for protection of fragile articles during shipping and storage, and a method of packaging thereof, utilizes a space minimizing outer carton and a plurality of innerpacking support panels selectively attached to the contained article by means of a heat shrinkable overwrap or film. Two types of support panels are selectively employed including a first plurality of cushioning pads having a spaced top, bottom, and side wall structure which creates an air space therebetween, and a second plurality of separator panels for insertion adjacent non-fragile or separable components of the contained article.

The effective horizontal dimensions of the support panels exceed the largest horizontal diameter of the article being packaged, and is further substantially equal to the effective inner dimensions of the outer carton. Thus the wrapped article and the component thereof are held against movement within the carton; the carton itself is reinforced.

2 Claims, 5 Drawing Figures

METHOD AND APPARATUS FOR PACKAGING FRAGILE ARTICLES

BACKGROUND AND SUMMARY OF PRESENT INVENTION

Manufacturers and distributors of fragile, oddshaped articles such as lamps and objects d'art expend large amounts of money on the development of new packaging methods and containers for shipping and storage of the articles. The cost of the packaging is necessarily added into the purchase price of the article and borne by the consumer. Additionally, when the packaging fails and the article is damaged or destroyed, the expense of that loss is ultimately borne by the consumer. Thus, the packaging of the articles for storage and/or shipment becomes an important element in the pricing function of such merchandise.

Early approaches to the individual packaging of fragile or breakable items in cartons included the design of a plethora of cardboard reinforcing elements. Such elements were bent, folded and so squeezed in between the articles and the sides, top and bottom of the cartons as to prevent movement of the article in any direction. Such attempts were and are satisfactory from the standpoint of accomplishing the stabilizing purpose; however, they are very expensive and each product requires a redesign of the reinforcing elements. There is essentially no standardization for different articles. Styrofoam reinforcing elements have recently replaced the cardboard material, but the same problems of lack of standardization exists. In addition, many molds are required.

Shrink film packaging has now offered some solution to the problem. Examples of some of the prior art approaches to such packaging are in U.S. Pat. Nos. 3,642,127; 3,675,765; and 4,030,603. These patents disclose the use of shrink film packaging to secure fragile articles such as lamps, motors, furniture in a stationary position within a container to prevent its being damaged by movement within the box. Most of these also disclose some type of separate reinforcement of the carton to strengthen against crushing when groups of packed containers are stacked one on top of another. However, certain deficiencies exist in these conventional packages which, until the present invention, have not been satisfactorily overcome.

Those deficiencies include the necessity of utilizating a much larger and frequently bulkier package than necessary in order to receive a variety of items. Alternatively, and equally unsatisfactory, is the customizing of a container for each specific article; both of these approaches being expensive. Further problems are ease of damage to the packaged article from blows or shock exterior to the container, and the necessity of providing a variety of inner packs and cushioning materials customized to the article and/or container. As previously stated, all of these deficiencies ultimately increase the cost of the article while simultaneously not being a substantial improvement to an unsatisfactory package.

The present invention, however, is believed to overcome the above cited deficiencies in that it provides a simple packaging container which is adaptable to a variety of articles, is compact and need be only slightly larger than the article contained within. Unique support in the form of flat plates or cushioning pads are provided so that within the basic outer container, the packaging may be easily customized to a given article. In its simplest and most general scope, the invention utilizes at least two spaced end panels and a heat shrink cover. As the film shrinks, the panels are urged together frictionally holding the article for horizontal movement in the carton. The bag is vertically stablized by gluing the bag to the carton or filling it with cushioning pads.

The support panels include flat or planar members inserted at the ends or between separable components of the article which merely prevent collapse of carton sidewalls. The cushioning pads include a pair of vertically spaced horizontal walls with adjoining sidewalls, which wall structure creates an inner air pocket or cushion. The air pocket serves as a cushion which will help absorb blows delivered from a vertical direction and vibrations potentially damaging to the article. The cushioning pads generally are placed under the bottom and over the top of fragile portions of the article, before shrink wrapping, for maximizing the cushioning effect.

The support panels and article to be packaged are secured together with a shrink film bag made from heat shrinkable material. When subjected to heat the film bag shrinks radially inwardly and also axially to pull the support panels together, frictionally stabilizing the article therebetween from movement in any direction. At that point the tightly wrapped article is placed in the outer container and one end secured by glue to the bottom of the carton. The support panels are of such a diameter relative to the inside diameter of the container as to fit snugly therein. Thus, the packed article is held securely in position and movement within the container in any direction is minimized.

With regard to prevention of damage by stacking packed containers on top of each other, the inner packing materials, i.e., support panels, are designed not only to cushion the article and prevent damage from dropping or falling, but also to decrease the likelihood of the outer container collapsing under the weight of other packages or from crushing blows and the like by supporting the container walls from within.

In a preferred embodiment both the outer container and the inner support panels are constructed from a relatively heavy weight corrugated paper product which is both strong and economical. Thus, the objects of the present invention include the provision of: a packaging container for fragile articles which is of an economical and simple construction adaptable for use with a variety of articles; a basic packaging container utilizing substantially the same inner packs and cushioning materials in a variety of combinations adaptable to a variety of articles; a packaging container requiring minimal space for warehousing and shipping; a packaging container providing reduced packaging time and materials cost, and a packaging container substantial enough to minimize damage to the contained article from sources exterior to the package. Other and further objects and advantages will become apparent to those skilled in the art as the following detailed description is studied in conjunction with the accompanying drawings, of which:

DETAILED DESCRIPTION OF A PREFERRED EMBODIMENT

Figure 1:
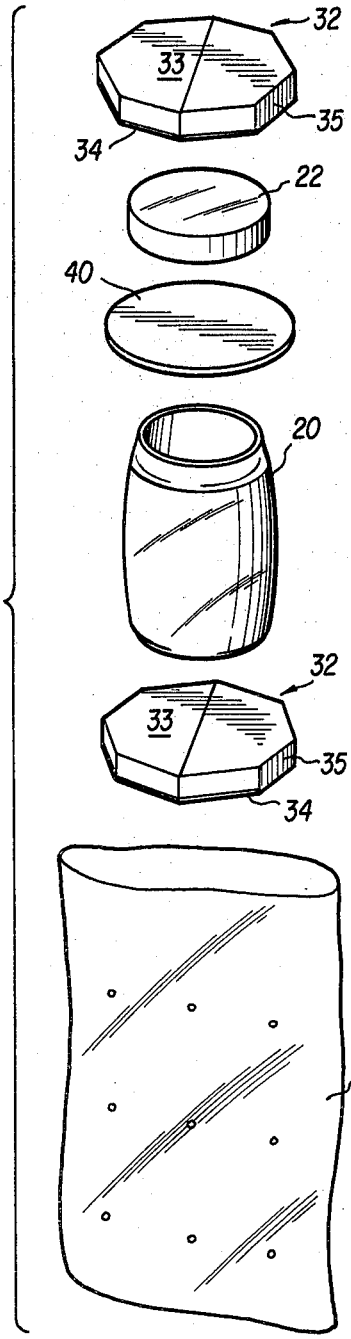
FIG. 1 is an exploded perspective view illustrating the various components of the invention as they are assembled.

Looking first to FIG. 1, an article assembly 10 is illustrated, in exploded perspective, as it would be structured for shipping and/or storage of a fragile article such as a vase, ginger jar, etc. The subject article in this instance is a decorative ginger jar including a body or jar portion 20, open at the top, and a top or cover 22. It is prepared for shipping by separating and securing the body 20 and the top 22 between a plurality of support panels.

Figure 3:
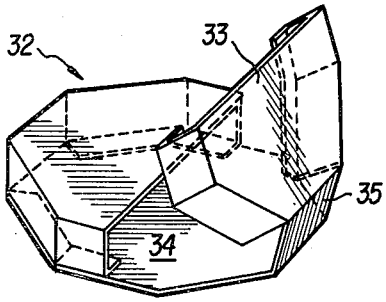
FIG. 3 is a perspective view illustrating a cushioning pad.
Figure 5:
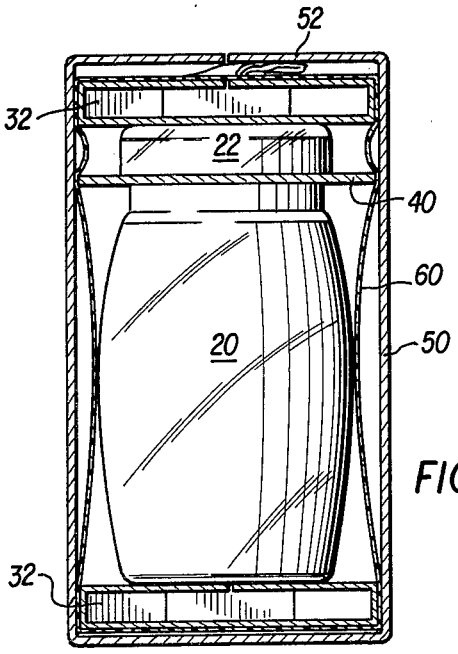
FIG. 5 is a sectional view of the assembled article packaged in a carton for shipment.

The support panels in this instance include cushioning pads 32 on the top and bottom, and a planar separator member 40 between the jar 20 and top 22. The cushioning pad 32 is formed of a top wall 33, a second or bottom wall 34 spaced from top wall 33, and adjoining sidewalls 35 (see FIG. 3). This wall structure provides an air cushion therebetween which helps absorb shocks or vibrations to the upper and lower fragile portions of a container 50 and prevent or at least minimize damage to the article elements 20,22. Pads 32 are formed by die cutting and folding according to conventional corrugated techniques.

In the illustrations the cushioning pads 32 are preferably octagonal and of a diameter slightly greater than the outer dimensions of the jar 20, and substantially the same as the inside diameter of the outer container 50, so that the cushioning pads fit snugly therein. The octagonal shape is preferred because it is easily formed, the alternate sides correspond to the four sides of a rectangular shipping container 50, and such shape will require less shrink wrap material. It is obvious that circles or other configurations cut to substantially the same diameter as the inner surfaces of the container 50 can be utilized quite satisfactorily; the primary objective being that the size of the pads 32 is larger than the article to maintain the positioning of the article in relationship to the package walls. Further, the pads reinforce the side walls of the carton.

The flat separator member 40 comprises a generally flat, plate-like configuration of substantially the same diameter as the cushioning pads 32. The separators 40 are employed when it is desirable to separate components of an article such as the jar and top, 20 and 22, to prevent their movement against each other and perhaps chipping or cracking in the instance of porcelain, crystal, etc. Further, members 40 also serve to reinforce the side walls of the carton.

The article is stacked or interspersed with the selected combination of support panels 32 and/or 40 into a shirnk bag or cover 60. The bag is then subjected to heat (to approximately 300° F. for 20 seconds) to shrink wrap the article (see FIG. 2). The wrapped article is then inserted into carton 50 and the open top 52 closed and appropriately sealed. where the sides of the carton 50 are longer than the longitudinal dimension of the assembled and wrapped article 10, the bottom of the assembly is preferably glued to the bottom wall of the carton or filled with padding. At this point, the article 20 and 22 is held securely between the panels 32 and 40 and movement thereof within the container 50, laterally or otherwise, is prevented.

Figure 4:
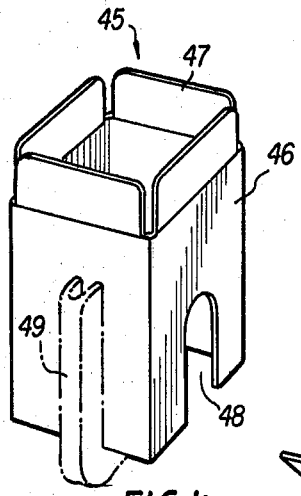
FIG. 4 is a perspective view of a lamp socket protective cover.
Figure 2:
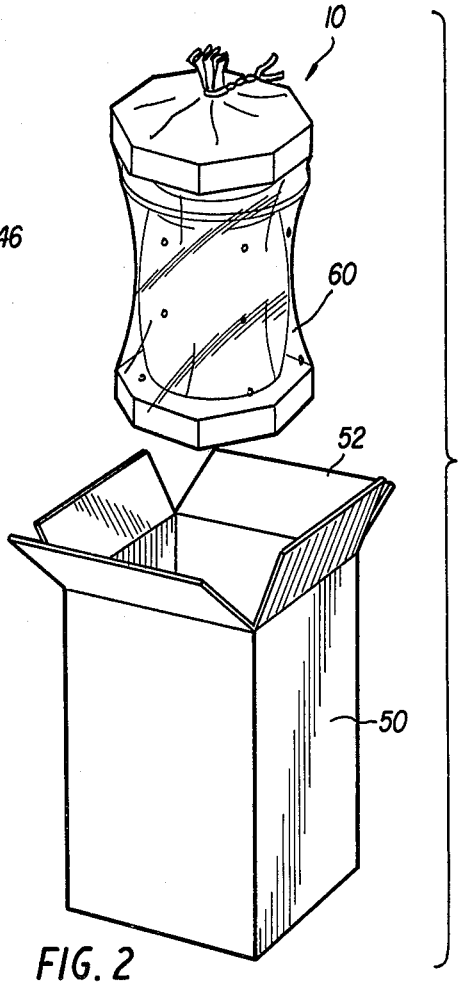
FIG. 2 is another exploded perspective view illustrating the assembled article as it is placed in a shipping carton.

As shown in FIGS. 1 and 2, the packaging container 50 is adapted for use with articles such as vases, ginger jars, etc. The packaging may also be adapted to lamp bases. In this respect, a socket protector 45 (FIG. 4) should be utilized. The socket protector has side walls 46 which are longer than the corresponding length of the socket above the harp support 49. Thus when the protective cover 45 is secured to the panel (either cushion pad 32 or flat member 40) by means of glue or with tabs 47, the top panel does not press against the top edge of the socket, preventing damage thereto. Slot 48 merely allows cover 45 to slip down over the conventional switch button. Where tabs 47 are used, obviously the top panel, whether it be a cushioning pad 32 or panel member 40, must have corresponding slits therein to receive the tabs 47 in a well known manner.

It should be pointed out that while FIGS. 1 and 2 and the description above show and describe the upper and lower support panel as being of the cushioning pad 32 type, this is not always necessary. For instance, where the article being packaged includes central portions which are fragile and top or bottom portions which are not, e.g. a lamp base with a wooden base and a china central portion, the upper or lower panels might be of the flat member 40 type and the separator panels might be of the cushioning pad type.

A study of this detailed description will therefore teach the construction of a packaging container and method of packing thereof, which provides for the protective separation of the separable components of a fragile article. The method and apparatus are economical in practice and considerably reduce the likelihood of damage to the article during shipping and storage. Relatively inexpensive materials are used to construct the package; the package may be customized through the utilization of flexible innerpacking materials, and volume and size of the outer containers are substantially reduced to maximize the use of storage and shipping space.

Other and further modifications will become apparent to those skilled in the pertinent art, but it is to be understood that such modifications may be made while remaining within the scope of the claims below.

What is claimed is:

1. A packaging container for the protection of fragile articles during shipping and storage, said container comprising:

(a) an outer carton having top, bottom and side walls;

(b) a plurality of support panels having horizontal dimensions effectively larger than the corresponding largest horizontal dimension in the article being shipped and substantially the same as the inner dimensions between said side walls;

(c) said support panels being positioned with at least one panel at the extreme upper end of said article and another panel at the extreme bottom end of said article;

(d) said support panel including a plurality of cushioning pads, each of said pads having vertically spaced first and second horizontal walls and adjoining vertically extending side walls, said walls defining an air cushion therebetween; and (e) a cover made from heat shrinkable film material surrounding the ends of said upper and lower panels and extending therebetween;

whereby after being subjected to heat and placed in said carton, said assembly prevents movement of said article in any direction.

2. The packaging assembly according to claim 1 and further including a protective cover for lamp sockets, said protective cover comprising side walls greater in length than the corresponding length of the socket, the lower edge of said side walls supported by the conventional harp support and connected at their upper ends by the upper of said upper support panels, whereby pressure is kept off the upper end of said lamp socket.

* * * * *